US005449325A

United States Patent [19]

Dransfield et al.

[11] Patent Number: 5,449,325

[45] Date of Patent: Sep. 12, 1995

[54] HAND ATTACHED CUE REST

[76] Inventors: Paul J. Dransfield; Ewan Le Marquand, both of c/o DFL Partners, 12 Rue Des Pres Trading Estate, Longueville, St. Saviour, Jersey JE2 9QM, Channel Islands, Channel Islands

[21] Appl. No.: 39,249

[22] Filed: Jun. 7, 1993

[30] Foreign Application Priority Data

Oct. 10, 1990 [GB] United Kingdom ..... 9022008

[51] Int. Cl.[6] ..... A63D 15/10

[52] U.S. Cl. ..... 473/43

[58] Field of Search ..... 273/23, 24; 473/42, 473/43

[56] References Cited

U.S. PATENT DOCUMENTS

| | | | |
|---|---|---|---|
| 196,568 | 10/1877 | Doughty | 473/42 |
| 215,848 | 5/1879 | Watson | 473/42 |
| 242,877 | 6/1881 | Bryant | 273/24 |
| 953,167 | 3/1910 | Furey | 273/24 |
| 2,014,788 | 9/1935 | Strickler | 473/42 |
| 2,817,525 | 12/1957 | Niemann | 473/42 |
| 3,372,929 | 3/1968 | Molls | 273/23 |
| 3,416,794 | 10/1965 | Ciano . | |
| 3,576,324 | 4/1971 | Lareau | 483/42 |
| 4,210,325 | 5/1978 | McCann . | |

FOREIGN PATENT DOCUMENTS

| | | | |
|---|---|---|---|
| 1978 | 1/1906 | United Kingdom | 273/24 |
| 397937 | 9/1933 | United Kingdom . | |
| 632039 | 11/1949 | United Kingdom | 273/23 |
| 1192551A | 7/1986 | United Kingdom . | |
| 2186496A | 2/1987 | United Kingdom . | |

*Primary Examiner*—Theatrice Brown

*Attorney, Agent, or Firm*—Rockey, Rifkin and Ryther

[57] ABSTRACT

A cue rest has a guide (1) adapted to guide the striking end of a cue, and alternative holders (2, 3) for attaching the guide (1) either to a player's hand or to a conventional rest. One of the holders (2) is in the form of a clip (12) shaped an to fit onto the thumb of the player. The other holder (3) is in the form of a sleeve (115) which fits onto an arm of a convent rest. Each holder (2, 3) has a vertical post (10, 100) on which sleeve of the guide (1) is vertically adjustable.

6 Claims, 1 Drawing Sheet

HAND ATTACHED CUE REST

BACKGROUND OF THE INVENTION

This invention relates to a cue rest for use in snooker, pool or similar games.

As is well known, a player of such games uses a cue for striking a ball on a table. In normal play, the cue is held at its outer end with one hand while the other hand is placed on the table near the ball to be struck and forms a rest or bridge along which the other end of the cue can be slid into contact with the ball. It sometimes happens that the ball to be addressed is obstructed by a cushion of the table or by another ball or halls. In such cases even a skilled player may have difficulty in making an effective manual bridge. Similar problems arise with conventional cue rests for use in striking balls that are out of reach. Such cue rests support the tip end region of the cue at a fixed height above the table, which may be undesirable for certain shots.

It is an object of the present invention to provide an improved cue rest for obviating or mitigating the aforesaid disadvantages.

According to the present invention there is provided a novel cue rest comprising a guide adapted to guide the striking end of a cue, and a holder adapted to hold said guide on a player's hand and/or on a conventional rest.

Preferably, the guide and the holder are vertically spaced so as to provide a greater elevation for the striking end of the cue than would otherwise be the case. Advantageously, the guide is adjustable with respect to the holder so as to vary said elevation.

Preferably, the guide is detachable from and/or rotatable respect to the holder.

Preferably, the holder adapted to hold the guide on a player's hand is a clip adapted to engage the player's thumb.

Preferably, the holder adapted to hold the guide on a conventional cue rest (with crossed arms) is a sleeve adapted to fit over an upper one of said arms and having a rearwardly angled support for receiving the guide, the angle between the support and the sleeve being such that in use the guide is supported centrally over the conventional rest.

BRIEF DESCRIPTION OF THE DRAWINGS

The invention will now be further described by way of example only, with reference to the accompanying drawings in which.

DETAILED DESCRIPTION

Figure 1:
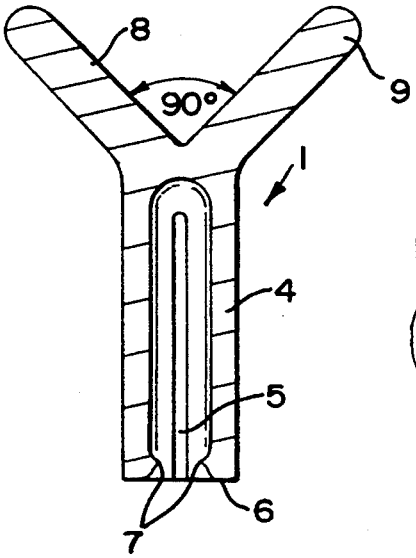
FIGS. 1, 2 and 3 are respectively a vertical section, underneath plan view and side elevation of a guide forming part of one embodiment of cue rest in accordance with the invention.
Figure 2:
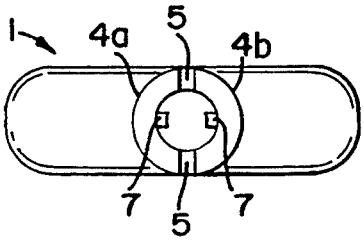
Figure 3:
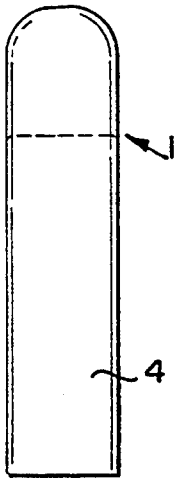
Figure 4:
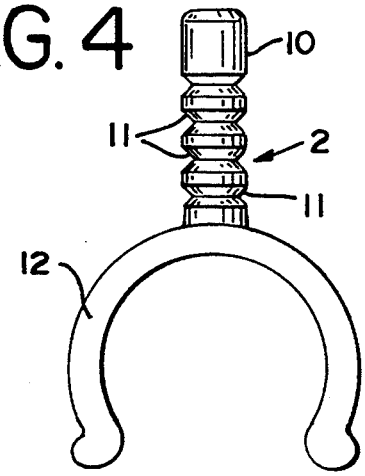
FIGS. 4 and 5 are respectively a side view and a vertical section of a first holder of the cue rest, for manual use.
Figure 5:
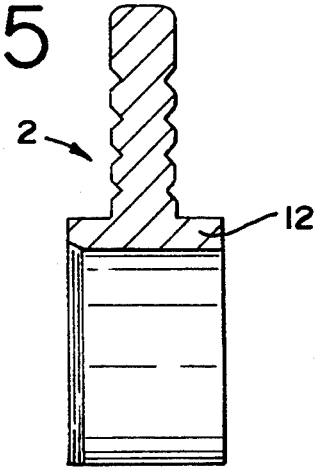
Figure 6:
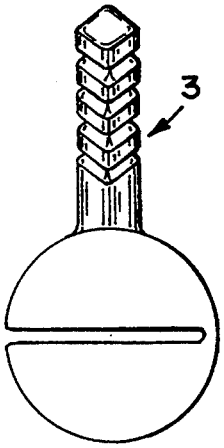
FIGS. 6, 7 and 8 are respectively an end elevation (from the right of FIG. 7), a side elevation and a further end elevation (from the left of FIG. 7) of an alternative holder of the cue rest.
Figure 7:
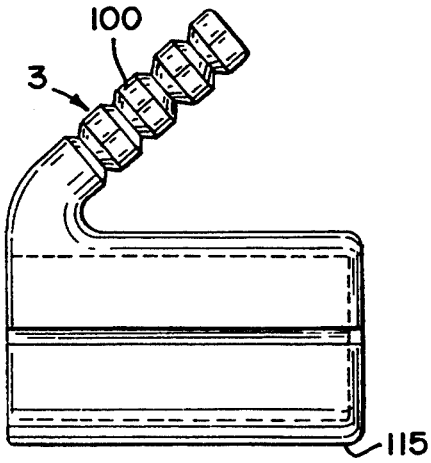
Figure 8:
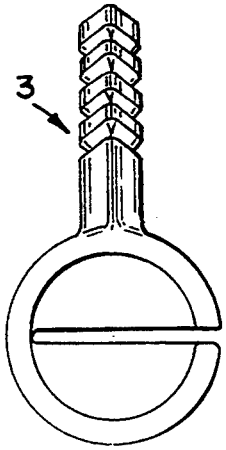

Referring now to the drawings, a cue rest comprises a guide 1 (FIGS. 1 to 3) attached either to a first holder 2 (FIGS. 4 and 5) or to a second holder (FIGS. 6 to 8). All three components are preferably moulded in synthetic plastics material.

The guide 1 has a hollow tubular body 4 which is split longitudinally by two equally spaced slots 5 which open at the open lower end 6 of the body 4 so as to divide the body 4 into two parts 4*a*, 4*b* which can move resiliently together and apart to a limited extent. Integrally moulded internally of the lower end of the body 4 are teeth 7. At its upper end the tubular body 4 bifurcates into two solid arms 8, 9 inclined at 90° relative to each other and positioned symmetrically with respect to the longitudinal axis of the body 4. The angular region between the arms 8, 9 serves to guide the striking end of a cue in the same way as a conventional rest with crossed arms.

The first holder (FIGS. 4 and 5) comprises a solid post 10 dimensioned to fit within the tubular body 4 of the guide 1. The post 10 has a number (in this case 4) axially spaced annular recesses 11 engageable by the teeth 7 at the lower end of the tubular body 4. By engaging the teeth 7 in a selected recess 11 the combined length of the tubular body 4 and the post 10 can be adjusted between four settings in a telescopic manner. The relative flexibility of the parts 4*a* and 4*b* of the tubular body 4 enables the teeth 7 to ride over the post segments between adjacent recesses 11. With the teeth 7 engaged in any recess 11 the angular position of the arms 8, 9 relative to the post 10 is stable by virtue of friction but the tubular body 4 is nevertheless rotatable relative to the post 10 with some difficulty using manual pressure.

The lower end of the post 10 is integral with a C-shaped clip 12 having an axial dimension (from left to right in FIG. 5) somewhat greater than the width of the tubular body 4. The clip 12 is so shaped and dimensioned as to fit onto the thumb between the first and second knuckles. With the holder so positioned on the player's hand and the guide 1 fixed to the post 10 at the desired elevation and relative angle, the cue rest can be used for playing the difficult shots described in the introduction.

The second holder illustrated in FIGS. 6 to 8 has a post 100 identical to the post 10 and fitting into the guide 1 in precisely the same way. In this case, however, instead of being connected to a clip, the post 100 is integral with the open end of a split cylindrical sleeve 115 such that the axis of the post 100 and the axis of the sleeve 115 make an angle of 45° relative to each other. The sleeve 115 is a tight fit on an upper arm of a conventional cue rest with crossed arms of which the upper arms are angled at 90° to each other. With the sleeve 115 so fitted the open inner end of the sleeve 115 is positioned adjacent the intersection of the crossed arms of the conventional rest and in consequence the post 100 extends upwards from said intersection. The guide 1, when positioned on the post 100, will therefore guide the cue in a direction parallel to and directly above the direction in which the cue would be guided by the conventional rest in the absence of the novel cue rest.

It will be appreciated that numerous modifications may be made without departing from the scope of the invention as herein defined. For example, the guide 1 need not be telescopically adjustable with respect to the holder 2 or 3. If the guide 1 requires to be detachable with respect to the holder 2 or 3 a screw connection may be provided. Alternatively, the guide 1 may be permanently connected to or integral with the holder 2 or 3 although it is preferred that the guide and the holders be detachable in order that a single guide may serve for both holders. The spacing between the guide and the holder, or more precisely between the angle included by the arms 8, 9 on the one hand and the axis of the clip 12 or sleeve 115 on the other hand, may be reduced to a minimum if the novel cue rest is not intended to provide extra elevation for the cue but merely to provide an artificial as opposed to a manual bridge for the cue. The guide and the holder need not take the illustrated forms, e.g. the angled arms 8, 9 may be replaced by a curved cue support, the holder 12 may be in the form of a sleeve as in the case of the holder 115, and the holder 115 may be in the form of a clip for attachment to the conventional cue rest.

We claim:

1. A cue rest comprising: a guide adapted to guide the striking end of a cue, and a support for the guide, wherein the support is in the form of a clip shaped and dimensioned to fit onto the thumb of a player, and the guide is adjustably supported on the holder so as to enable variation of the elevation of the striking end of the cue relative to the support and to enable rotation of the guide relative to the support.

2. A cue rest as claimed in claim 1, wherein the guide is interchangeable between a first holder in the form of a clip and a second holder in the form of a sleeve, the first holder being adapted to hold the guide in the player's hand and the second holder being adapted to hold the guide on a conventional cue rest.

3. A cue rest as claimed in claim 1, wherein the guide and the support are interconnected by interengaging male and female formations capable of telescopic adjustment.

4. A cue rest as claimed in claim 3, wherein the male and female formations have detent means selectively engageable with spaced recesses providing a fixed number of discrete extension positions of said formations.

5. A cue rest as claimed in claim 4, wherein the male formation is a post with a plurality of peripheral grooves constituting said recesses spaced axially therealong and the female formation is a hollow tubular body divided lengthwise into segments carrying internal projections constituting said detent means engageable in said grooves and capable of riding over post sections intermediate the grooves.

6. A cue rest as claimed in claim 3, wherein frictional engagement between the male and female formations permits intended but prevents unintended twisting of the guide relative to the holder.

* * * * *